US008773033B2

(12) United States Patent
Yang et al.

(10) Patent No.: US 8,773,033 B2
(45) Date of Patent: Jul. 8, 2014

(54) DRIVING METHOD FOR BACKLIGHT UNIT OF LIQUID CRYSTAL DISPLAY AND SYSTEM THEREOF

(75) Inventors: Xiang Yang, Guangdong (CN); Xinming Gao, Guangdong (CN); Fei Li, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 134 days.

(21) Appl. No.: 13/582,908

(22) PCT Filed: Jun. 20, 2012

(86) PCT No.: PCT/CN2012/077213
§ 371 (c)(1),
(2), (4) Date: Sep. 5, 2012

(87) PCT Pub. No.: WO2013/163839
PCT Pub. Date: Nov. 7, 2013

(65) Prior Publication Data

US 2013/0293136 A1 Nov. 7, 2013

(30) Foreign Application Priority Data

May 4, 2012 (CN) ..... 2012 1 037473

(51) Int. Cl.
*H05B 37/02* (2006.01)

(52) U.S. Cl.
USPC ..... 315/224; 315/345; 315/276

(58) Field of Classification Search
None
See application file for complete search history.

(56) References Cited

U.S. PATENT DOCUMENTS

| | | | | |
|---|---|---|---|---|
| 4,513,224 | A * | 4/1985 | Thomas | 315/141 |
| 4,538,095 | A * | 8/1985 | Nilssen | 315/244 |
| 4,554,487 | A * | 11/1985 | Nilssen | 315/224 |
| 5,719,474 | A * | 2/1998 | Vitello | 315/307 |
| 6,633,138 | B2 * | 10/2003 | Shannon et al. | 315/224 |
| 7,443,107 | B2 * | 10/2008 | Shannon et al. | 315/224 |
| 7,977,890 | B2 * | 7/2011 | Kumagai | 315/247 |
| 8,179,053 | B2 * | 5/2012 | Lin et al. | 315/224 |
| 8,421,739 | B2 * | 4/2013 | Chung et al. | 345/102 |
| 8,552,963 | B2 * | 10/2013 | Ito et al. | 345/102 |
| 8,598,800 | B2 * | 12/2013 | Uchimoto et al. | 315/247 |
| 2002/0003525 | A1 | 1/2002 | Hwang | |
| 2007/0268236 | A1 * | 11/2007 | Morrow | 345/102 |
| 2008/0284346 | A1 * | 11/2008 | Lee | 315/224 |
| 2009/0128045 | A1 * | 5/2009 | Szczeszynski et al. | 315/185 R |
| 2009/0251062 | A1 * | 10/2009 | Hagino et al. | 315/276 |
| 2009/0302776 | A1 * | 12/2009 | Szczeszynski | 315/246 |
| 2011/0279045 | A1 * | 11/2011 | Uchimoto et al. | 315/186 |

FOREIGN PATENT DOCUMENTS

| | | |
|---|---|---|
| CN | 101340760 | 1/2009 |
| CN | 202120578 | 1/2012 |
| CN | 201289537 | 4/2012 |
| JP | 10-213789 | 8/1998 |

* cited by examiner

*Primary Examiner* — Crystal L Hammond
(74) *Attorney, Agent, or Firm* — Muncy, Geissler, Olds & Lowe, P.C.

(57) ABSTRACT

A method for driving the backlight unit of the liquid crystal display includes: comparing the strength of a soft start signal with a predetermined signal through a comparator circuit, and generating a first comparison signal or a second comparison signal according to the comparison result; outputting a first frequency from a frequency modulation circuit according to the first comparison signal; and increasing the rising rate of the output voltage of a boost converter according to the first frequency. Therefore, the rising rate of the output voltage is increased, thereby solving the screen-flickering problem.

11 Claims, 2 Drawing Sheets

DRIVING METHOD FOR BACKLIGHT UNIT OF LIQUID CRYSTAL DISPLAY AND SYSTEM THEREOF

FIELD OF THE INVENTION

The present invention relates to a method for driving a backlight unit of liquid crystal display and the system thereof, and more particularly to a method for driving a backlight unit having various rate of voltage rise and the system thereof.

BACKGROUND OF THE INVENTION

A liquid crystal display is mainly consists of a liquid crystal display panel and a backlight unit. The liquid crystal display panel includes a color filter substrate, a thin film transistor substrate, and a liquid crystal layer interposed between the thin film transistor substrate and the color filter substrate. Since the liquid crystal display panel itself is a non-emissive device, the backlight unit is required to provide light for achieving the display function; that is, the backlight unit is employed to provide sufficient brightness and uniform light source, thereby allowing the liquid crystal display to display images normally.

Presently, the development of the light-emitting diode (LED) light source has a breakthrough influence on the liquid crystal display products. The significant improvement on the luminous efficacy of the LED allows it to have half the efficiency of a cold cathode fluorescent lamp (CCFL). Further, LED is a low-power spontaneous light source, usually used as auxiliary light source for power efficiency products. Hence, various studies had equipped the backlight unit of liquid crystal display with LEDs as a light source thereof.

Generally, when using LEDs as a backlight light source, a plurality of LEDs is electrically connected to each other in series. Therefore, in order to drive the LEDs, a higher direct voltage (DC voltage) is required. As a result, a DC-DC boost converter is provided in the driving system of the backlight unit to drive the LEDs.

FIG. 1 illustrates a schematic diagram of the DC-DC boost converter. The DC-DC boost converter 100 includes a DC power source 110, an inductor 120, an output capacitor 150, a diode 130, and a bipolar junction transistor (BJT) 140.

The DC power source 110 includes a negative electrode terminal and a positive electrode terminal connected to one end of the inductor 120. The other end of the inductor 120 is connected to the collector of the BJT 140 and the anode of the diode 130. The cathode of the diode 130 is grounded via the output capacitor 150. The emitter of the BJT 140 is grounded, and the base of the BJT 140 is electrically connected to a switch circuit 160. The switch circuit 160 is used to control the on and off of the BJT 140. Here, the voltage of the DC power source 110 equals to the input voltage of the DC-DC boost converter 100.

In the following description, referring to FIG. 1, the action of the DC-DC boost converter 100 will be explained. As shown in FIG. 1, it is assumed that when the switch circuit 160 provides the BJT 140 with a voltage signal of low electric potential, the BJT 140 is turned off, and after a sufficient period of time, all the components are in ideal state and the voltage of the two ends of the output capacitor 150 equals to the input voltage.

Next, charging and discharging process of the boost converter will be described. During the charging process, the switch circuit 160 provides the base of the BJT 140 with a voltage signal of high electric potential, and the BJT 140 is turned on. At this time, electrical current from the DC power source 110 flows through the inductor. The diode 130 prevents the capacitor from discharging to the ground. Since the DC power source 110 inputs direct current, the electrical current within the inductor 120 increases linearly by a constant ratio, wherein the ratio is related to the size of the inductor 120. With the current within the inductor 120 increases, the energy stored in the inductor 120 also grows.

During the discharging process, the switch circuit 160 provides the base of the BJT 140 with a voltage signal of low electric potential, and the BJT 140 is turned off. At this time, owing to the characteristics of the inductor 120, the current flowing through thereof will go slowly from the initial current value stored during the discharging process to zero, instead of becoming zero immediately. The original circuit is broken; hence, the current of the inductor 120 may only discharge through the output capacitor 150. That is, when the inductor 120 begins to charge the output capacitor 150, the voltage of the two ends of the output capacitor 150 will rise. The voltage of the two ends of the output capacitor 150 equals to the output voltage of the DC-DC boost converter 100.

In practice, during the charging process, the current flowing through the inductor 120 has a constant maximum value. Thus, if the difference between the input voltage and the output voltage is too big, for instance, the input voltage being 24V and the output voltage being 300V, then it requires multiple charging and discharging processes to achieve desired output voltage. Therefore, the more often the DC-DC boost converter 100 charges and discharges, the faster the output voltage rises.

However, when the output voltage reaches the desired voltage value, the loading (not shown) of the DC-DC boost converter 100 starts to work normally, which means that the loading begins the power consumption thereof, decreasing the voltage of the two ends of the output capacitor 150. In order to maintain a constant output voltage, the DC-DC boost converter 100 has to continue the charging and discharging process.

An oscillator is generally used in the switch circuit of the backlight unit for outputting a constant frequency in order to control the on and off of the bipolar junction transistor, and thereby maintain the stability of the output voltage. Yet, when turning on the liquid crystal display, a certain amount of time is required to allow the voltage of the two ends of the output capacitor to reach the voltage value enough for driving the loading. The loading herein refers to the light emitting diodes employed as the light source of the backlight unit. Due to the characteristics of the light emitting diode, a small amount of electrical current will flow through the light emitting diode when the output voltage rises to a certain value even though the desired voltage value has not yet reached, causing the light emitting diodes to glimmer a faint light. At this point, because the voltage rising time takes long enough, human eyes may see the light emitting diodes lighting up slowly, and perceive that the light emitting diodes are flickering.

Hence, a method for driving backlight unit of liquid crystal display and the system thereof that could prevent human eyes from perceiving the flickering of the LEDs is required in order to overcome the foregoing deficiencies.

SUMMARY

One objective of the present invention is to provide a driving method for novel backlight unit to overcome the flickering problem caused by the existing backlight unit driving method according to the prior art. The present invention is intended to solve the technical problem of the LED flickering caused by the output voltage of the boost converter rising too slowly, resulting in image quality reduction.

Another objective of the present invention is to provide a driving system for the backlight unit employing novel circuit structure to overcome the flickering problem caused by the existing backlight unit driving system. The present invention is intended to solve the technical problem of the LED flickering caused by the output voltage of the boost converter rising too slowly, resulting in image quality reduction.

To achieve the above-mentioned objective, the present invention provides a method for driving the backlight unit of the liquid crystal display including: comparing the strength of a soft start signal with a predetermined signal through a comparator circuit, and generating a first comparison signal or a second comparison signal according to the comparison result; outputting a first frequency from a frequency modulation circuit according to the first comparison signal; and increasing the rising rate of the output voltage of a boost converter according to the first frequency.

In one embodiment of the present invention, it further includes: generating the first comparison signal through the comparator circuit when the soft start voltage signal is smaller than the predetermined voltage signal.

In one embodiment of the present invention, it further includes: generating the second comparison signal when the soft start voltage signal is larger than the predetermined voltage signal; outputting a second frequency from the frequency modulation circuit according to the second comparison signal; and decreasing the rising rate of the output voltage of the boost converter according to the second frequency.

In one embodiment of the present invention, the first frequency is higher than the second frequency.

In one embodiment of the present invention, the rising rate of the output voltage of the boost converter controlled by the first frequency is faster than the rising rate of the output voltage of the boost converter controlled by the second frequency.

To achieve the above-mentioned objective, the present invention provides a driving system for the backlight unit of the liquid crystal display including: a comparison circuit, including a first end for receiving a predetermined voltage signal, a second end for receiving a soft start signal, and a comparison signal outputting end, for outputting a comparison signal according to the predetermined voltage signal and the soft start signal; a frequency modulation circuit including a comparison signal inputting end and a frequency outputting end, wherein the comparison signal inputting end is electrically connected to the comparison signal outputting end, and an oscillating frequency is outputted by the frequency outputting end according to the comparison signal; a boost converter electrically connected to the frequency outputting end, and controls the rising rate of a voltage signal according to the oscillating frequency; and a soft start circuit including a soft start signal outputting end, wherein the soft start signal outputting end is electrically connected to the boost converter, receives the voltage signal and outputs the soft start signal from the soft start signal outputting end according to the voltage signal, and then transmits the soft start signal to the comparison circuit.

In one embodiment of the present invention, a first comparison signal is generated by the comparison signal outputting end when the predetermined voltage signal is larger than the soft start signal.

In one embodiment of the present invention, a second comparison signal is generated by the comparison signal outputting end when the predetermined voltage signal is smaller than the soft start signal.

In one embodiment of the present invention, the frequency modulation circuit includes: a switch, including a first end, a second end, and a control end electrically connected to the comparison signal inputting end, wherein the control end controls the electrical connection state between the first end and the second end; a first electric resistor including a first end electrically connected to the second end of the switch, and a second end electrically connected to a reference voltage; a second electric resistor including a first end electrically connected to the first end of the switch, and a second end electrically connected to the second end of the first electric resistor; and an oscillator, including a frequency controlling end electrically connected to the first end of the second electric resistor, wherein the oscillating frequency is outputted from the frequency outputting end according to the resistance value measured by the frequency controlling end.

In one embodiment of the present invention, it further includes: a power switch for generating a switch signal; a third electric resistor, including a first end electrically connected to the power switch and receives a switch signal, and a second end electrically connected to the first end of the comparison circuit and outputs the predetermined voltage signal; and a fourth electric resistor, including a first end electrically connected to the second end of the third electric resistor, and a second end electrically connected to a reference voltage.

As the foregoing, the present invention providing a method for driving backlight unit of liquid crystal display and the system thereof has an advantageous effect in that, by using two different frequencies to control the rising rate of the output voltage of the boost converter (mainly using the first frequency to allow the output voltage of the boost converter to quickly reach the desired voltage value), the screen-flickering problem caused by a slow rising rate of the output voltage of the boost converter may be prevented.

The previous description of the present invention is only a schematic and brief illustration provided to enable a better understanding of the technical solution of the invention and to allow the practice of the invention according to the description. Hereinafter, the preferred embodiment of the present invention will be described in detail with reference to the accompanying drawings.

DETAILED DESCRIPTION OF THE EMBODIMENTS

Now, the preferred embodiment of the present invention will be described in detail with reference to the accompanying drawings.

Figure 1:
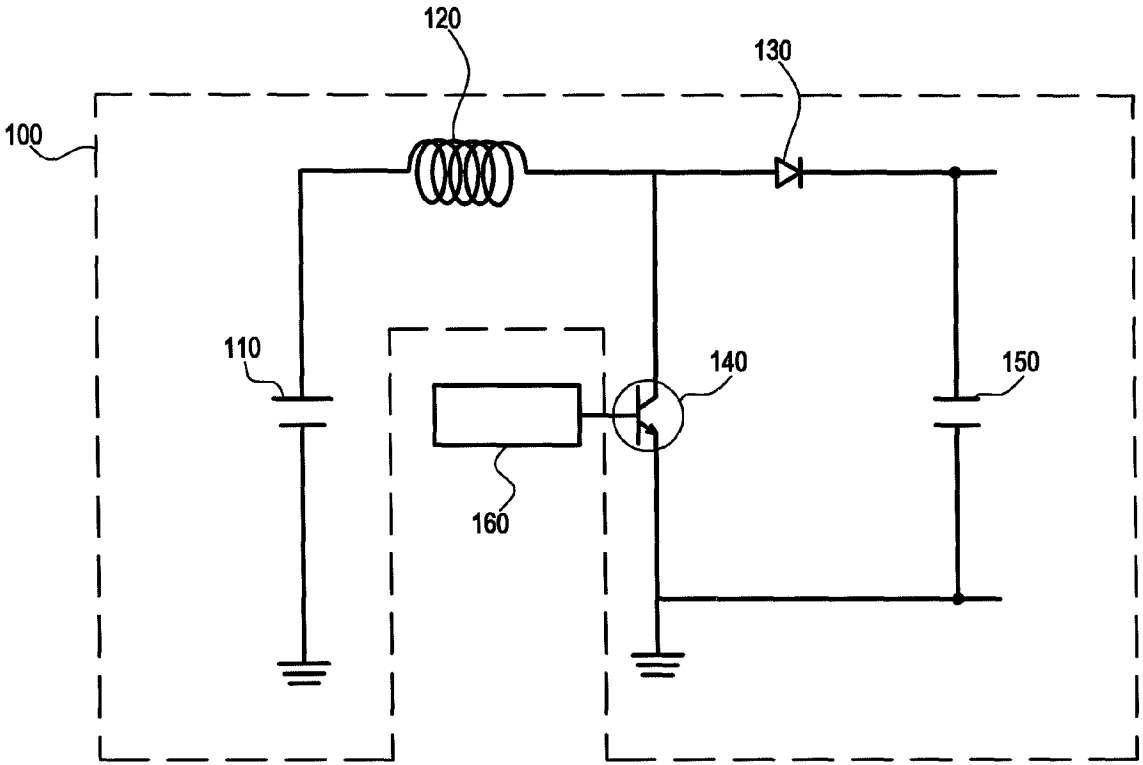
FIG. 1(prior art)
FIG. 1 illustrates a schematic diagram of a conventional DC-DC boost converter.
Figure 2:
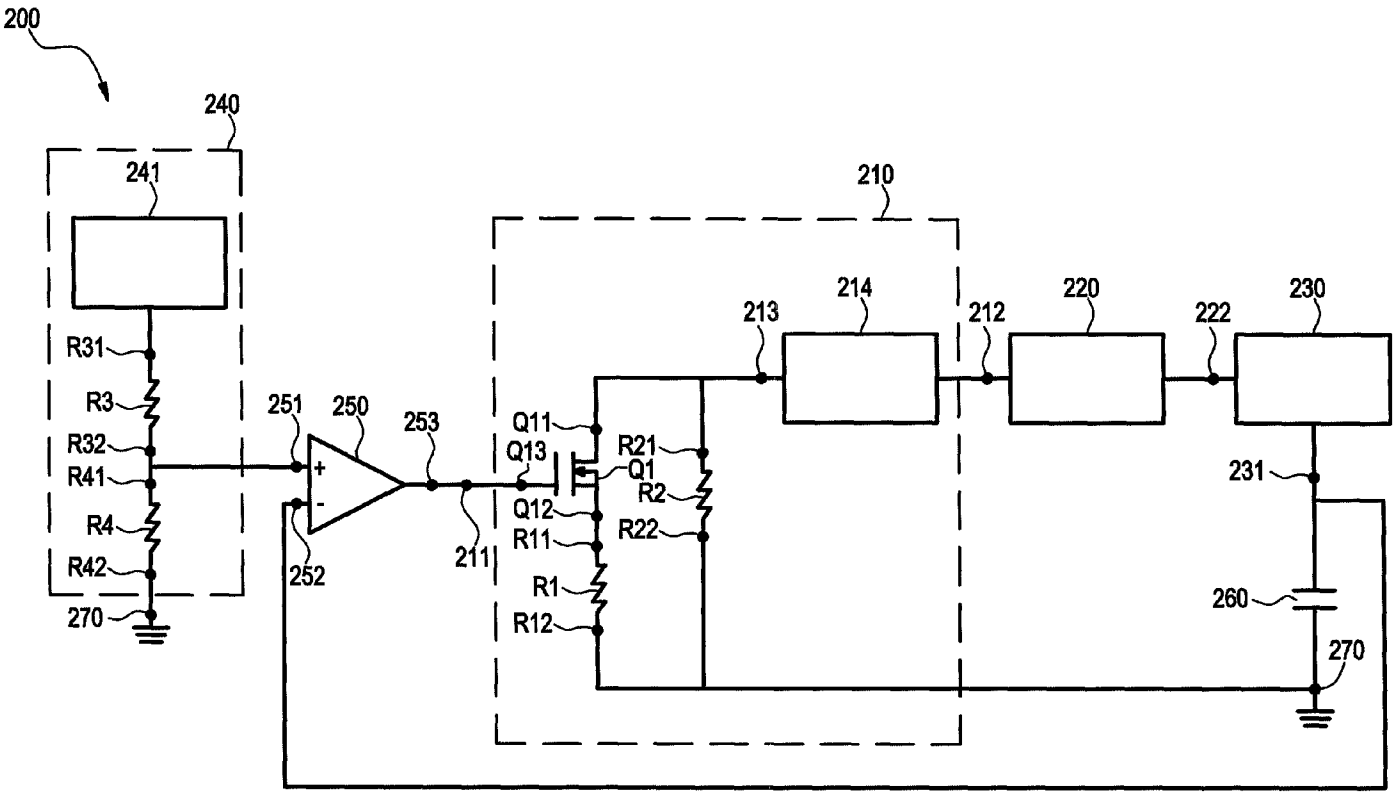
FIG. 2 illustrates the backlight unit driving system according to the embodiment of the present invention.

FIG. 2 illustrates the backlight unit driving system according to the embodiment of the present invention. The backlight unit driving system 200 includes a frequency modulation circuit 210, a boost converter 220, a soft start circuit 230, a predetermined voltage circuit 240, and a comparison circuit. In the present embodiment, the comparison circuit is a comparator 250 constituted by an operational amplifier (OA), which includes a first end 251 (the positive end of the comparator 250), a second end 252 (the negative end of the comparator 250), and a comparison signal outputting end 253. Wherein, the frequency modulation circuit 210 includes a comparison signal inputting end 211 and a frequency outputting end 212. Wherein, the soft start circuit 230 includes a soft start signal outputting end 231.

The predetermined voltage circuit 240 includes a power switch 241, a third electric resistor R3, and a fourth electric resistor R4. Wherein, the third electric resistor R3 includes a first end R31 and a second end R32. Wherein, the fourth electric resistor R4 includes a first end R41 and a second end R42.

The first end R31 of the third electric resistor R3 is electrically connected to the power switch 241. The first end R41 of the fourth electric resistor R4 is electrically connected to the second end R32 of the third electric resistor R3. The second end R42 of the fourth electric resistor R4 is electrically connected to a reference voltage 270, wherein the reference voltage 270 is of zero-voltage level, also referred to as a grounding connection. The first end 251 of the comparator 250 is electrically connected to the second end R32 of the third electric resistor R3, and the second end 252 of the comparator 250 is electrically connected to the soft start signal outputting end 231. The comparison signal outputting end 253 of the comparator 250 is electrically connected to the comparison signal inputting end 211.

An oscillating frequency is outputted by the frequency outputting end 212 of the frequency modulation circuit 210 according to the comparison signal. The frequency modulation circuit 210 includes a first electric resistor R1, a second electric resistor R2, a switch Q1, and an oscillator 214. Wherein, the first electric resistor R1 includes a first end R11 and a second end R12. Wherein, the second electric resistor R2 includes a first end R21 and a second end R22. Wherein, the oscillator 214 includes a frequency controlling end 213. Wherein, the switch Q1 is a Metal-Oxide-Semiconductor Field-Effect Transistor (MOSFET), and includes a first end Q11, a second end Q12, and a control end Q13.

The control end Q13 of the switch Q1 is electrically connected to the comparison signal inputting end 211, the first end Q11 of the switch Q1 is electrically connected to the frequency controlling end 213 and the first end R21 of the second electric resistor R2, the second end Q12 of the switch Q1 is electrically connected to the first end R11 of the first electric resistor R1. The second end R12 of the first electric resistor R1 is electrically connected to the reference voltage 270. The second end R22 of the second electric resistor R2 is electrically connected to the reference voltage 270. The frequency outputting end 212 outputs various oscillating frequencies according to the resistance values measured by the frequency controlling end 213.

The boost converter 220 is electrically connected to the frequency outputting end 212, controls the voltage rising rate of an output voltage according to the oscillating frequency, and then outputs the output voltage via a boost converter outputting end 222.

The soft start circuit 230 is electrically connected to the boost converter outputting end 222 of the boost converter 220, and receives the output voltage. The soft start signal outputting end 231 is electrically connected to the reference voltage 270 via a capacitor 260.

The soft start circuit 230 outputs the soft start signal via soft start signal outputting end 231 according to the amount of the output voltage, and transmits the soft start signal to the second end 252 of the comparator 250.

Hereinafter, the driving method of the backlight unit driving system 200 shown in FIG. 2 will be described. Referring to FIG. 2, when the backlight unit driving system 200 is activated, the power switch 241 of the predetermined voltage circuit 240 is turned on, generating a switch signal, and by means of the voltage division of the third electric resistor R3 and the fourth electric resistor R4, outputs a predetermined voltage signal from the second end R32 of the third electric resistor R3 to the first end 251 of the comparator 250 (the predetermined voltage signal is 2V in the present embodiment). Since the backlight unit driving system 200 has just been activated, the soft start signal outputting end 231 of the soft start circuit 230 is a low voltage level (lower than 2V), and is outputted to the second end 252 of the comparator 250. The signal strength of a soft start signal and a predetermined voltage signal is compared through the comparison circuit, and a first comparison signal is generated according to the comparison result. Since the first end 251 of the comparator 250 is the positive end and the second end 252 is the negative end, hence when the soft start voltage signal is smaller than the predetermined voltage signal, a first comparison signal obtained is a positive voltage signal, and outputted through the comparison signal outputting end 253 of the comparator 250.

According to the first comparison signal, the frequency modulation circuit 210 outputs a first frequency. Since the first comparison signal is a positive voltage signal, the switch Q1 of the frequency modulation circuit 210 is turned on, and the resistance value measured by the frequency controlling end 213 is a resistance value of parallel resistance of the first electric resistor R1 and the second electric resistor R2. The oscillator 214 outputs a first frequency through the frequency outputting end 212 according to the resistance value measured by the frequency controlling end 213. As the foregoing, the boost converter 220 increases the rising rate of the output voltage of the boost converter 220 according to the first frequency. The soft start circuit 230 controls the output signal outputted from the soft start signal outputting end 231 to below a voltage signal of 2V according to the output voltage of the boost converter.

When the output voltage of the boost converter 220 is higher than a certain amount, the output signal of the soft start signal outputting end 231 is larger than a voltage signal of 2V. The first end 251 of the comparator 250 is the positive end and the second end 252 is the negative end, therefore when the soft start voltage signal is larger than the predetermined voltage signal, a second comparison signal is generated. The second comparison signal is a negative voltage signal, outputted from the comparison signal outputting end 253 of the comparator 250.

According to the second comparison signal, the frequency modulation circuit 210 outputs a second frequency. Since the second comparison signal is a negative voltage signal, the switch of the frequency modulation circuit 210 is turned off, and the resistance value measured by the frequency controlling end 213 is the resistance value of the second electric resistor R2. The oscillator 214 outputs a second frequency through the frequency outputting end 212 according to the resistance value of the second electric resistor R2 measured by the frequency controlling end 213. As the foregoing, the boost converter 220 decreases the rising rate of the output voltage of the boost converter 220 according to the second frequency.

In the present embodiment, the first frequency is higher than the second frequency, thus the rising rate of the boost converter 220 controlled by the first frequency is faster than the rising rate of the boost converter 220 controlled by the second frequency.

As the foregoing, the present invention providing a method for driving backlight unit of liquid crystal display and the system thereof has an advantageous effect in that, by using two different frequencies to control the rising rate of the output voltage of the boost converter (using the first frequency to allow the output voltage of the boost converter to quickly reach the desired voltage value), the screen-flickering problem caused by a slow rising rate of the output voltage of the boost converter may be prevented.

The previous description of the preferred embodiment is provided to further describe the present invention, not intended to limit the present invention. Any modification apparent to those skilled in the art according to the disclosure within the scope will be construed as being included in the present invention.

What that is claimed is:

1. A driving method for backlight unit of liquid crystal display, comprising:

comparing a strength of a soft start signal with a predetermined signal through a comparator circuit, and generating a first comparison signal or a second comparison signal according to a comparison result;

outputting a first frequency from a frequency modulation circuit according to the first comparison signal;

increasing a rising rate of an output voltage of a boost converter according to the first frequency;

generating the first comparison signal through the comparator circuit when the soft start voltage signal is smaller than the predetermined voltage signal; generating the second comparison signal when the soft start voltage signal is larger than the predetermined voltage signal;

outputting a second frequency from the frequency modulation circuit according to the second comparison signal; and decreasing the rising rate of the output voltage of the boost converter according to the second frequency, wherein the first frequency is higher than the second frequency, and the rising rate of the output voltage of the boost converter controlled by the first frequency is faster than the rising rate of the output voltage of the boost converter controlled by the second frequency.

2. A driving method for backlight unit of liquid crystal display, comprising:

comparing a strength of a soft start signal with a predetermined signal through a comparator circuit, and generating a first comparison signal or a second comparison signal according to the comparison result;

outputting a first frequency from a frequency modulation circuit according to the first comparison signal; and increasing a rising rate of an output voltage of a boost converter according to the first frequency.

3. The driving method of claim 2, further comprising:

generating the first comparison signal through the comparator circuit when the soft start voltage signal is smaller than the predetermined voltage signal.

4. The driving method of claim 2, further comprising:

generating the second comparison signal when the soft start voltage signal is larger than the predetermined voltage signal;

outputting a second frequency from the frequency modulation circuit according to the second comparison signal; and decreasing the rising rate of the output voltage of the boost converter according to the second frequency.

5. The driving method of claim 4, wherein the rising rate of the output voltage of the boost converter controlled by the first frequency is faster than the rising rate of the output voltage of the boost converter controlled by the second frequency.

6. The driving method of claim 2, wherein the first frequency is higher than the second frequency.

7. A driving system for backlight unit of liquid crystal display, comprising:

a comparison circuit, including:

a first end for receiving a predetermined voltage signal, a second end for receiving a soft start signal, and a comparison signal outputting end, for outputting a comparison signal according to the predetermined voltage signal and the soft start signal;

a frequency modulation circuit including a comparison signal inputting end and a frequency outputting end, wherein the comparison signal inputting end is electrically connected to the comparison signal outputting end, and an oscillating frequency is outputted by the frequency outputting end according to the comparison signal;

a boost converter electrically connected to the frequency outputting end, and controls a rising rate of a voltage signal according to the oscillating frequency; and a soft start circuit including a soft start signal outputting end, wherein the soft start signal outputting end is electrically connected to the boost converter, receives the voltage signal and outputs the soft start signal from the soft start signal outputting end according to the voltage signal, and then transmits the soft start signal to the comparison circuit.

8. The driving system of claim 7, wherein a first comparison signal is generated by the comparison signal outputting end when the predetermined voltage signal is larger than the soft start signal.

9. The driving system of claim 7, wherein a second comparison signal is generated by the comparison signal outputting end when the predetermined voltage signal is smaller than the soft start signal.

10. The driving system of claim 7, wherein the frequency modulation circuit includes:

a switch including:

a first end, a second end, and a control end electrically connected to the comparison signal inputting end, wherein the control end controls an electrical connection state between the first end and the second end;

a first electric resistor including:

a first end electrically connected to the second end of the switch, and a second end electrically connected to a reference voltage;

a second electric resistor including:

a first end electrically connected to the first end of the switch, and a second end electrically connected to the second end of the first electric resistor; and an oscillator, including a frequency controlling end electrically connected to the first end of the second electric resistor, wherein the oscillating frequency is outputted from the frequency outputting end according to a resistance value measured by the frequency controlling end.

11. The driving system of claim 7, further comprising:

a power switch for generating a switch signal;

a third electric resistor including:

a first end electrically connected to the power switch and receives a switch signal, and a second end electrically connected to the first end of the comparison circuit and outputs the predetermined voltage signal; and a fourth electric resistor including:

a first end electrically connected to the second end of the third electric resistor, and a second end electrically connected to a reference voltage.

* * * * *